United States Patent [19]
Borowski
[11] 4,194,517
[45] Mar. 25, 1980

[54] FILTER FOR CIGARETTES, CIGARILLOS OR PIPES

[75] Inventor: Horst Borowski, Hamburg, Fed. Rep. of Germany

[73] Assignee: B.A.T. Cigaretten-Fabriken GmbH, Hamburg, Fed. Rep. of Germany

[21] Appl. No.: 837,559

[22] Filed: Sep. 28, 1977

[30] Foreign Application Priority Data

Oct. 6, 1976 [DE] Fed. Rep. of Germany ..... 2645036

[51] Int. Cl.[2] ..... A24B 15/02
[52] U.S. Cl. ..... 131/261 R
[58] Field of Search ..... 131/95, 88, 187, 200, 131/201-203, 261 R, 261 B, 262 R, 262 A, 266, 268; 55/387, 524, 527; 106/177, 249; 252/32.5, 435, 436; 423/223, 229, 309

[56] References Cited

U.S. PATENT DOCUMENTS 3,127,373 3/1964 Guttag ..... 131/262 A
3,246,654 4/1966 Stahly ..... 131/266
3,280,823 10/1966 Bavley et al. ..... 131/261 A
3,319,635 5/1967 Stahly ..... 131/266

*Primary Examiner*—Robert W. Michell
*Assistant Examiner*—C. F. Rosenbaum
*Attorney, Agent, or Firm*—Bierman & Bierman

[57] ABSTRACT

An improved fibrous filter is disclosed which is useful for removing harmful chemicals from tobacco smoke. This filter is characterized as containing at least one compound selected from the group consisting of (RO) PO $(OH)_2$ (I)
$(RO)_2$ PO (OH) (II)
(III)

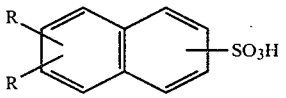

wherein R represents a straight-chain, branched or cyclic aliphatic hydrocarbon radical.

17 Claims, No Drawings

FILTER FOR CIGARETTES, CIGARILLOS OR PIPES

The present invention relates to a filter useful in removing harmful chemicals from tobacco smoke. This filter can be used in such items as cigarettes, cigarillos, and pipes. The filter can be permanently attached to the tobacco item (i.e. a "filtered" cigarette) or detached and applied to the tobacco item by the smoker. For example, the present invention is also applicable to filters which are packaged separately from the tobacco items.

It is known in the art to add solid ion exchangers to fibrous materials intended for filters used in removing harmful chemicals from tobacco smoke. These ion exchangers are used to improve the flavor of the tobacco smoke. Additionally, German PS No. 1 300 854 shows the addition of carboxylic acid alkyl esters to filters for the purpose of reducing the nicotine content in the tobacco smoke. The most useful of these esters is citric acid diethyl ester.

The present invention is directed to a filter as mentioned above which is characterized as surpassing the ability of the prior art filters to remove nicotine from tobacco smoke. Additionally, the present filter is also noted for its ability to remove other harmful chemicals from tobacco smoke such as keto compounds (i.e. acetone and acetaldehyde). Therefore, the filter of the present invention removes harmful constituents from tobacco smoke as well as rendering the smoke milder and more flavorful than conventional filters.

The foregoing objects can be achieved by utilizing a filter containing liquid phosphoric acid esters and/or naphthalene sulfonic acids which are insoluble in water and which are miscible with organic solvents. These compounds are represented by the following general formulae:

$(RO)\,PO\,(OH)_2$ (I)

$(RO)_2\,PO\,(OH)$ (II)

(III)

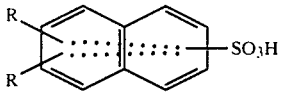

wherein R represents straight-chain, branched or cyclic aliphatic hydrocarbon radicals.

In accordance with a preferred embodiment of the present invention, the aliphatic radicals (R) may contain from 6 to 30, and preferably 8 to 20, carbon atoms.

Additionally, the amount of the phosphoric acid esters and/or naphthalene sulfonic acids which is added to the filtered material is between about 1 to 6 percent by weight, in particular 2 to 4 percent by weight, based on the total weight of the filter.

Examples of the compounds used in the present invention include monododecyl phosphoric acid (DDPA), monoheptadecyl phosphoric acid (HDPA), bis-(2-ethylhexyl) phosphoric acid (D2EHPA), and dinonyl naphthalene sulfonic acid (DNNS). The molecular weight of the individual R groups is chosen such that the molecular weight of the entire compound is preferably between about 200 and 600, and in particular between about 250 and 500.

There are two ways of producing the filter of the present invention. Choosing one of the two methods depends essentially on the type of filter material employed. More specifically, if the filter is made up of cellulose acetate or other synthetic fiber it will be necessary to add a hardener to the filter material. Typical hardeners include glycerine triacetate and diethylene glycol diacetate. The phosphoric acid esters and/or naphthalene sulfonic acids are dissolved in the hardener and applied in a conventional manner directly onto the fibers.

Filter fibers which do not require a hardener include those containing cellulose, polyethylene, or polypropylene. These fibers can be impregnated with the present compounds by dissolving the compounds in a volatile organic solvent and spraying the resulting solution onto the fibers. The solvent is subsequently removed in a conventional manner.

The compounds useful in the present invention are available commercially as liquid ion exchangers. These compounds are preferably characterized as (1) having at least one reactive group per molecule, (2) having an average molecular weight of between about 200 and 600, (3) being in a liquid state at room temperature, (4) being insoluble in water, (5) being miscible with organic solvents, and (6) having no emulsifying action.

The present compounds, when added to a fibrous filter material, produce a filter which is superior over those known in the prior art. Evidence of this assertion can be found in Table I wherein filters of the present invention are compared with filters prepared with the prior art citric acid diethyl ester. Table I shows that the nicotine content, utilizing the filter of the present invention, is reduced to almost one-half that of the prior art filter.

TABLE

| Filter additive | Filter length (mm) | Fibre titre (den) | Flow Resistance (mm water column | (%) Nicotine absorption | Absorption difference |
|---|---|---|---|---|---|
| 10% triacetin | 20 | 2.5/380000 | 64 | 48.4 | |
| 10% triacetin + 2.5% citric acid diethyl ester | 20 | 2.5/38000 | 60 | 57.1 | +8.7 |
| 10% triacetin | 20 | 2.1/38000 | 65 | 49.1 | |
| 10% triacetin + 2.5% citric acid diethyl ester | 20 | 2.1/38000 | 66 | 57.8 | +8.7 |
| 10% triacetin | 21 | 2.1/38000 | 68 | 45.4 | |
| 10% triacetin + 2.5% bis(2-ethylhexyl)phosphoric acid | 21 | 2.1/38000 | 72 | 61.2 | +15.8 |
| 10% triacetin | 21 | 2.1/38000 | 68 | 45.4 | |
| 10% triacetin + 5.0% bis(2-ethylhexyl)phosphoric acid | 21 | 2.1/38000 | 71 | 61.9 | +16.5 |

triacetin = glycerine triacetate

What we claim is:

1. An improved fibrous filter for removing harmful chemicals from tobacco smoke, containing at least one compound selected from the group consisting of $(RO)\,PO\,(OH)_2$ (I)

$(RO)_2\,PO\,(OH)$ (II)

(III)

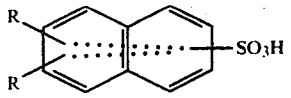

wherein R represents a straight-chain, branched, or cyclic aliphatic radical, said compound being insoluble in water and miscible with an organic solvent.

2. The filter of claim 1 wherein R is an aliphatic radical containing 6 to 30 carbon atoms.

3. The filter of claim 2 wherein R is an aliphatic radical having 8 to 20 carbon atoms.

4. The filter of claim 1 wherein said compound has a molecular weight of between about 200 and 600.

5. The filter of claim 4 wherein said molecular weight is between about 250 and 500.

6. The filter of claim 1 wherein said compound is between about 1 to 6 percent by weight based on the total weight of said filter.

7. The filter of claim 4 wherein said amount is between about 2 and 4 percent.

8. The filter of claim 1 wherein R is an aliphatic radical having 6 to 30 carbon atoms, said compound is present in an amount between about 1 to 6 percent by weight based on the total weight of said filter and has a molecular weight of between about 200 and 600.

9. The filter of claim 1 wherein said compound is selected from the group consisting of monododecyl phosphoric acid, monoheptadecyl phosphoric acid, bis-(2-ethylhexyl) phosphoric acid, and dinonyl naphthalene sulfonic acid.

10. The filter of claim 1 wherein said chemicals are selected from the group consisting of nicotine and keto compounds.

11. An improved fibrous filter for removing harmful chemicals from tobacco smoke, containing at least one compound of claim 1 of the formula

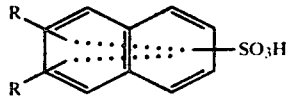

wherein R represents a straight-chain, branched, or cyclic aliphatic radical, said compound being insoluble in water and miscible with an organic solvent.

12. The filter of claim 1 further comprising fibers made from at least one selected from the group consisting of celulose and cellulose acetate.

13. The filter of claim 11 further comprising the presence of a carboxylic acid alkyl ester.

14. The filter of claim 13 wherein said ester is citric acid diethyl ester.

15. An improved fibrous filter containing cellulose or cellulose acetate and a carboxylic acid alkyl ester for removing harmful chemicals from tobacco smoke, said filter containing at least one compound selected from the group consisting of $(RO)\,PO\,(OH)_2$ (I)

$(RO)_2\,PO\,(OH)$ (II)

(III)

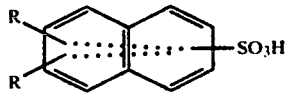

wherein R is an aliphatic radical having 8 to 20 carbon atoms in an amount of between about 1 to 6 percent by weight based on the total weight of said filter and having a molecular weight of between about 250 and 500.

16. The filter of claim 15 wherein said compound is selected from the group consisting of monododecyl phosphoric acid, monoheptadecyl phosphoric acid, bis-(2-ethylhexyl) phosphoric acid, and dinonyl naphthalene sulfonic acid.

17. A method of removing harmful chemicals from tobacco smoke comprising passing said smoke through a filter having a compound selected from the group consisting of $(RO)\,PO\,(OH)_2$ (I)

$(RO)_2\,PO\,(OH)$ (II)

(III)

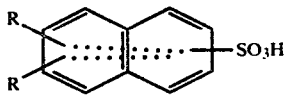

wherein R represents a straight-chain, branched or cyclic aliphatic radical, said compound being insoluble in water and miscible with an organic solvent.

* * * * *